US007731168B2

(12) United States Patent
Yamaguchi

(10) Patent No.: US 7,731,168 B2
(45) Date of Patent: Jun. 8, 2010

(54) ALIGNING UNIT AND IMAGE FORMING APPARATUS

(75) Inventor: Yoshihiro Yamaguchi, Osaka (JP)

(73) Assignee: Kyocera Mita Corporation (JP)

( * ) Notice: Subject to any disclaimer, the term of this patent is extended or adjusted under 35 U.S.C. 154(b) by 176 days.

(21) Appl. No.: 11/805,294

(22) Filed: May 23, 2007

(65) Prior Publication Data

US 2007/0273089 A1 Nov. 29, 2007

(30) Foreign Application Priority Data

May 25, 2006 (JP) ..... 2006-145303

(51) Int. Cl.

| | |
|---|---|
| ***B42B 2/00*** | (2006.01) |
| ***B42B 2/02*** | (2006.01) |
| ***B65H 5/30*** | (2006.01) |
| ***B65H 39/00*** | (2006.01) |
| ***B65H 41/00*** | (2006.01) |

(52) U.S. Cl. ..... 270/58.08; 270/58.07; 270/58.09; 270/58.11; 270/58.12; 270/58.17

(58) Field of Classification Search ..... 270/58.08, 270/58.11, 58.12, 58.17, 58.07, 58.09
See application file for complete search history.

(56) References Cited

U.S. PATENT DOCUMENTS 4,484,737 A * 11/1984 Sugiyama ..... 271/264

FOREIGN PATENT DOCUMENTS

| | | |
|---|---|---|
| JP | 2002-68578 | 3/2002 |
| JP | 2002-114433 | 4/2002 |
| JP | 2002114433 A * | 4/2002 |

* cited by examiner

*Primary Examiner*—Gene Crawford
*Assistant Examiner*—Yolanda Cumbess
(74) *Attorney, Agent, or Firm*—Gerald E. Hespos; Michael J. Porco

(57) ABSTRACT

An aligning unit is provided with a tray having a placing surface on which sheet-like transfer materials discharged with printing applied thereto are held stacked, a first restricting member movable back and forth along an advancing direction of the transfer material being discharged onto the tray while facing the front end of the transfer material with respect to the advancing direction, and a second restricting member for defining the rear end position of the transfer material with respect to the advancing direction. The transfer materials stacked on the tray are aligned by the first restricting member being moved back and forth along the advancing direction. The first restricting member includes a contact surface extending substantially vertically above the placing surface of the tray, and an inclined surface extending from the contact surface toward the placing surface and inclined downward along a direction opposite to the advancing direction.

15 Claims, 7 Drawing Sheets

ALIGNING UNIT AND IMAGE FORMING APPARATUS

BACKGROUND OF THE INVENTION

1. Field of the Invention

The present invention relates to an aligning unit for aligning transfer materials after printing and an image forming apparatus such as a copier, a printer or a facsimile machine provided with such an aligning unit.

2. Description of the Related Art

In an image forming apparatus, stapling of binding a plurality of transfer materials into a bunch, perforation or like post-processing is sometimes applied to transfer materials (paper sheets, resin films, etc.) after printing. For such a post-processing, image forming apparatuses have been conventionally proposed which are each provided with an aligning unit constructed such that a plurality of transfer materials (e.g. paper sheets, resin films) discharged to a tray defined in a main body of the image forming apparatus (called as an intermediate tray below in order to be distinguished from a discharge tray to be described later) are aligned, a resulting bunch of the transfer materials is moved to a post-processing position, and the bunch of the transfer materials after the post-processing is moved from the intermediate tray to a specified position to be discharged to a discharge tray (see, for example, Japanese Unexamined Patent Publication No. 2002-68578).

Such an aligning unit stacks the printed transfer materials discharged on the intermediate tray while positioning them with respect to forward and backward directions and transverse directions. The aligning unit includes restricting members opposed to each other. While one restricting member restricts the transfer materials at one end, the other restricting member is slid to restrict the transfer materials at the other end, thereby aligning the transfer materials. Thereafter, the aligned transfer materials are moved to the post-processing position for post processing such as stapling.

Here, in the case of, e.g. thermally fixing a toner image to the transfer material, an end portion of the transfer material discharged onto the intermediate tray is, in some cases, largely curled upward depending on the material of the transfer material, a hygroscopic state thereof or the like. If the transfer material is curled in such a way, it might not be aligned to a correct position upon being positioned.

A known construction taking such a problem into consideration is such that an oblique wall inclined toward the opposed restricting member as it extends from a placing surface of the intermediate tray toward the upper end is formed atop the slidable restricting member (see, for example, Japanese Unexamined Patent Publication No. 2002-114433). By this construction, the transfer material placed on the intermediate tray can be suitably aligned even if it is curled upward.

However, the above construction has a problem that the transfer material cannot be properly aligned if it is curled downward. Further, in a mode of performing alignment (sliding movement of the restricting member) every time one transfer material is conveyed, if only the conveyed transfer material is displaced from an alignment position when one transfer material is conveyed anew to the intermediate tray already bearing a plurality of transfer materials thereon, a part of the transfer material displaced from the alignment position is locally curled downward (hangs down) depending on the material of the transfer material. If alignment is performed in this state, the newly conveyed transfer material is sandwiched between the restricting member and the plurality of transfer materials placed (already aligned) at the alignment position and might be buckled.

SUMMARY OF THE INVENTION

It is an object of the present invention to provide an aligning unit and an image forming apparatus capable of highly precisely aligning a transfer material even if the transfer material is curled downward.

In order to accomplish this object, one aspect of the present invention is directed to an aligning unit, comprising a tray having a placing surface on which sheet-like transfer materials discharged with printing applied thereto are held stacked; a first restricting member movable back and forth along an advancing direction of the transfer material being discharged onto the tray while facing the front end of the transfer material with respect to the advancing direction; and a second restricting member for defining the rear end position of the transfer material with respect to the advancing direction, wherein the transfer materials stacked on the tray are aligned by moving the first restricting member back and forth along the advancing direction; and the first restricting member has a contact surface extending substantially vertically above the placing surface of the tray, and an inclined surface extending from the contact surface toward the placing surface and inclined downward along a direction opposite to the advancing direction.

Another aspect of the present invention is directed to an image forming apparatus, comprising an apparatus main body for applying an image forming process to a transfer material, and an aligning unit for aligning transfer materials after the image formation, the aligning unit having the above construction.

DETAILED DESCRIPTION OF THE PREFERRED EMBODIMENTS

Figure 1:
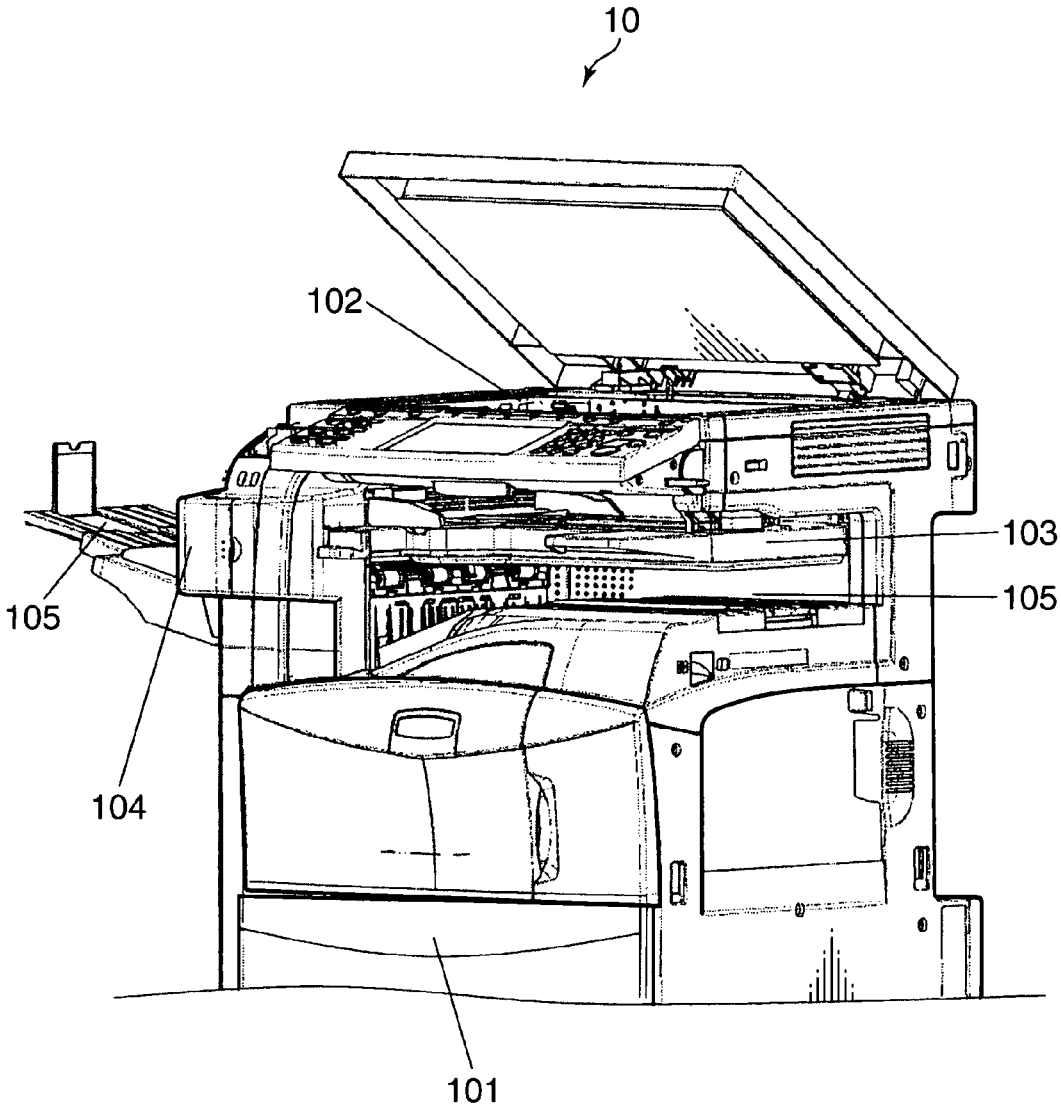
FIG. 1 is a perspective view showing the external configuration of an image forming apparatus provided with an aligning unit according to one embodiment of the invention.

Hereinafter, preferable embodiments of an aligning unit and an image forming apparatus according to the present invention are described with reference to the accompanying drawings. FIG. 1 is a perspective view showing the external configuration of an image forming apparatus 10 provided with an aligning unit according to one embodiment of the invention.

The image forming apparatus 10 is, as shown in FIG. 1, provided with a transfer material supplying unit 101 for supplying transfer materials such as paper sheets to be conveyed, an image reader 102 on which a document to be copied is placed, a transfer unit (not shown because being arranged in the image forming apparatus) for transferring a document image to a transfer material supplied from the transfer material supplying unit 101 based on the data (image) of the document read by the image reader 102, an aligning unit 103 for aligning the transfer materials for post-processing after the image transfer, a post-processing unit 104 for performing post-processing such as stapling, and a discharge tray 105 onto the discharged transfer materials are to be placed. It should be noted that the present invention is applicable to copiers, laser printers, FAX complex machines capable of performing post-processing.

Figure 2:
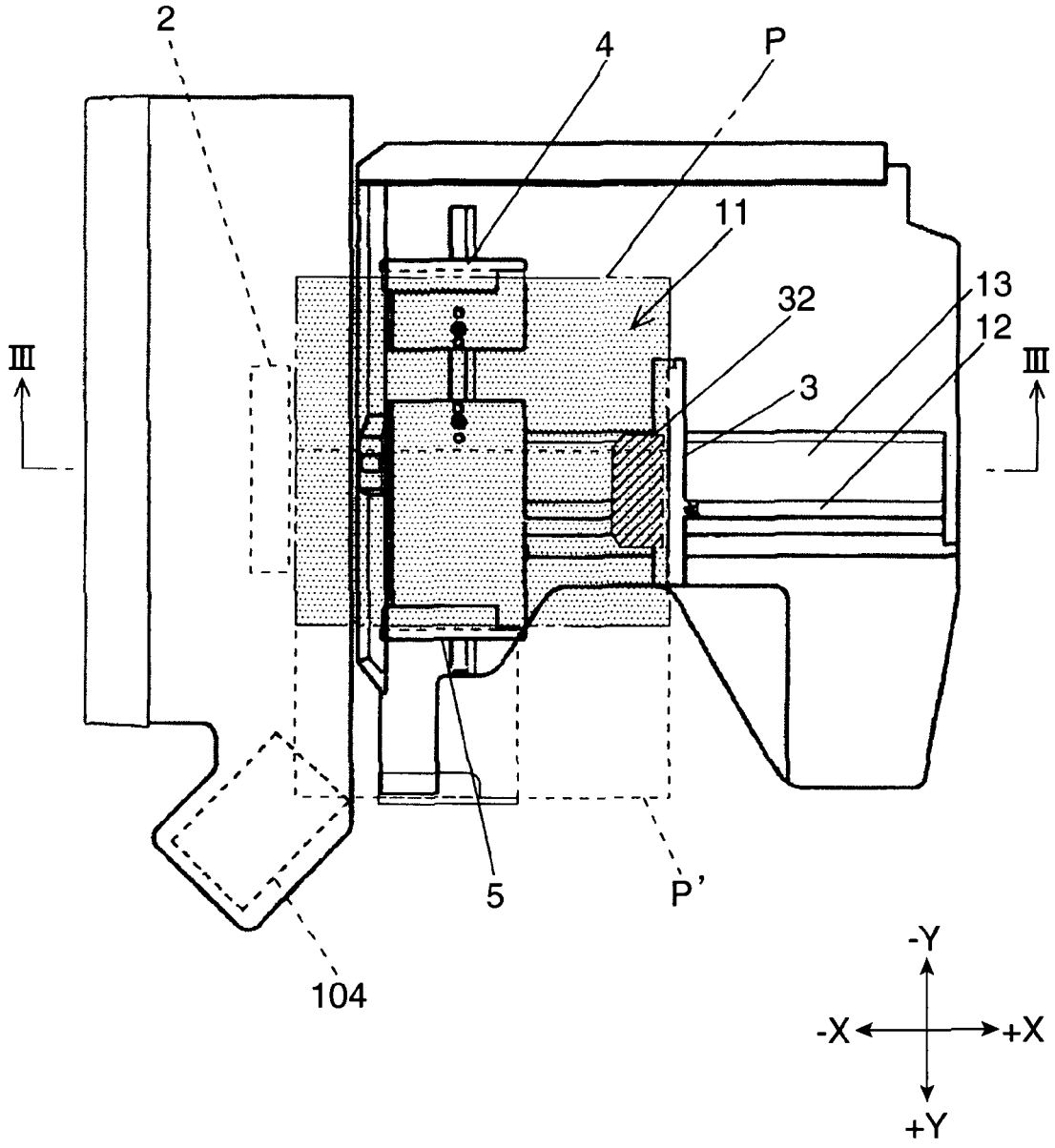
FIG. 2 is a schematic partial plan view of the image forming apparatus provided with the aligning unit according to the embodiment of the invention near an intermediate tray.
Figure 3:
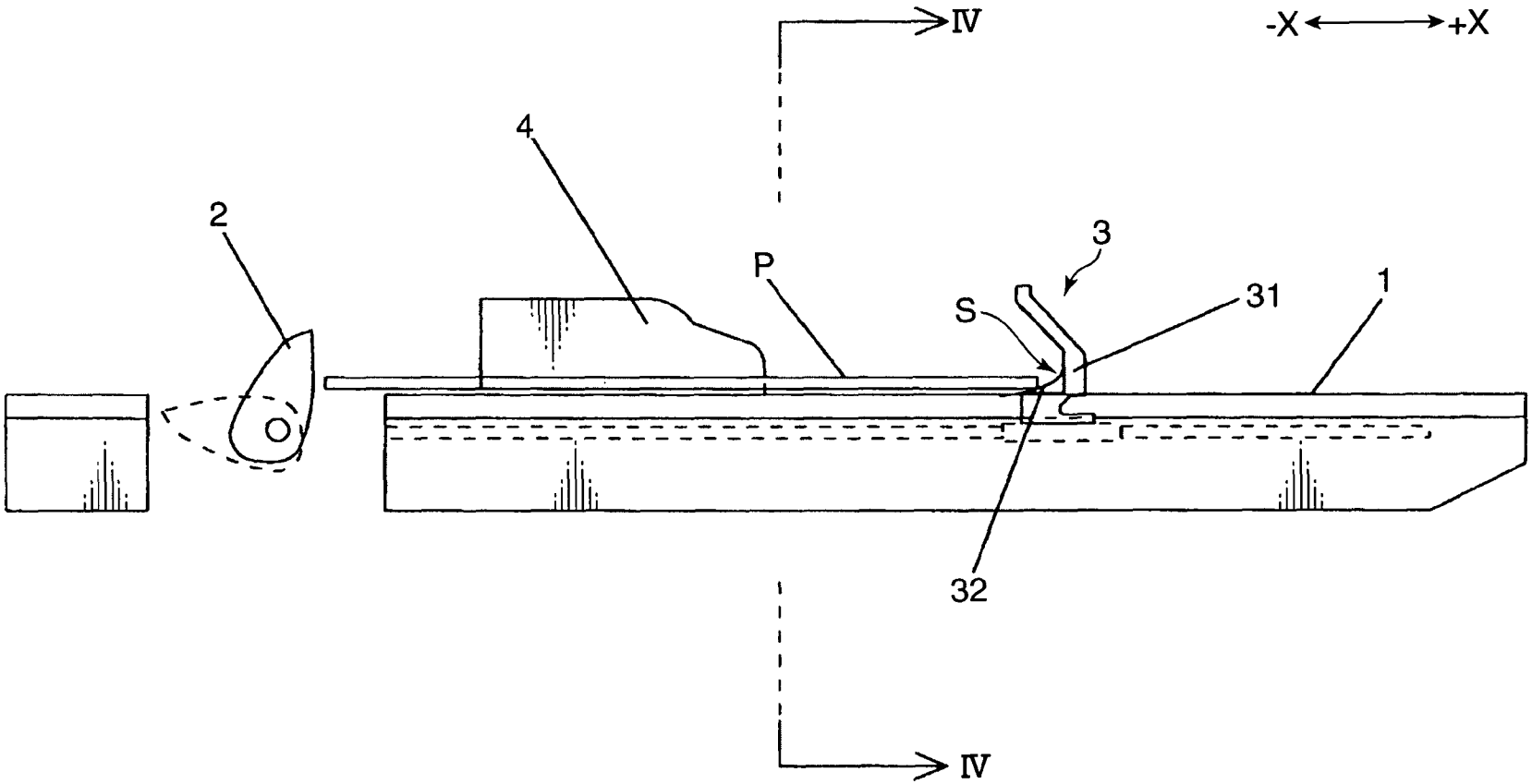
FIG. 3 is a section along III-III of FIG. 2.
Figure 4:
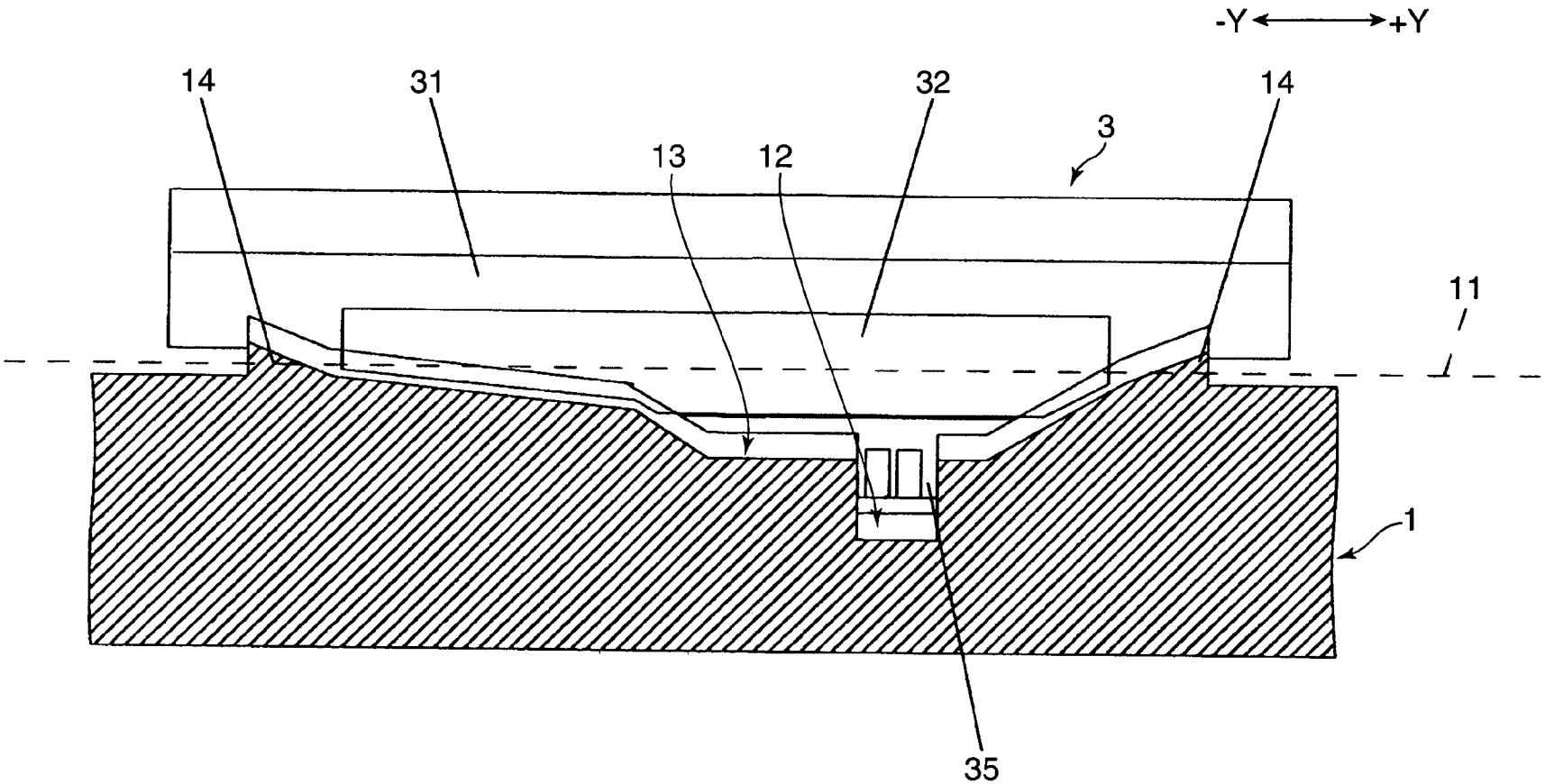
FIG. 4 is a section along IV-IV of FIG. 3.

FIG. 2 is a schematic partial plan view of the image forming apparatus 10 near the aligning unit 103 (intermediate tray 1), FIG. 3 is a section along III-III of FIG. 2, and FIG. 4 is a section along IV-IV of FIG. 3.

The aligning unit 103 of this embodiment includes a tray (hereinafter, called as an intermediate tray to be distinguished from the discharge tray 105) 1 having a placing surface 11 on which sheet-like transfer materials P discharged after having printing applied thereto are to be stacked. The aligning unit 103 also includes a front-end restricting member 3 (first restricting member) and a rear-end restricting member 2 (second restricting member).

The front-end restricting member 3 is movable back and forth along an advancing direction (+X direction) of the transfer material P to be discharged to the intermediate tray 1 (i.e. slidable along an X-axis direction) while being opposed to the front end of the transfer material P in the advancing direction. The rear-end restricting member 2 is for defining the rear-end positions of the transfer materials with respect to the advancing direction. The transfer materials P stacked on the intermediate tray 1 are aligned by the front-end restricting member 3 being moved back and forth along the advancing direction.

The front-end restricting member 3 has a contact surface 31 extending substantially vertically above the placing surface 11 of the intermediate tray 1, and an inclined surface S extending from the contact surface 31 toward the placing surface 11 and inclined downward toward a direction (−X direction) opposite to the advancing direction.

The rear-end restricting member 2 of this embodiment can be shifted between a standing posture (shown by solid line in FIG. 3) to restrict the transfer material P placed on the intermediate tray 1 and a retracted posture (shown by broken line in FIG. 3) to permit the transfer materials P to be discharged backward after the post-processing.

According to the aligning unit 103 constructed as above, the transfer materials P having images formed thereon in the transfer unit are received into the intermediate tray 1 in the case of applying specified post-processing. The rear-end restricting member 2 is in the standing posture to restrict the one end (rear end) of each transfer material P on the intermediate tray 1 with the transfer materials P accommodated on the intermediate tray 1, whereas the front-end restricting member 3 opposed to the rear-end restricting member 2 restricts the other ends of the transfer materials P while sliding in the X-axis direction (forward or backward direction). In this way, the transfer material P can be aligned to a specified alignment position.

Figure 5:
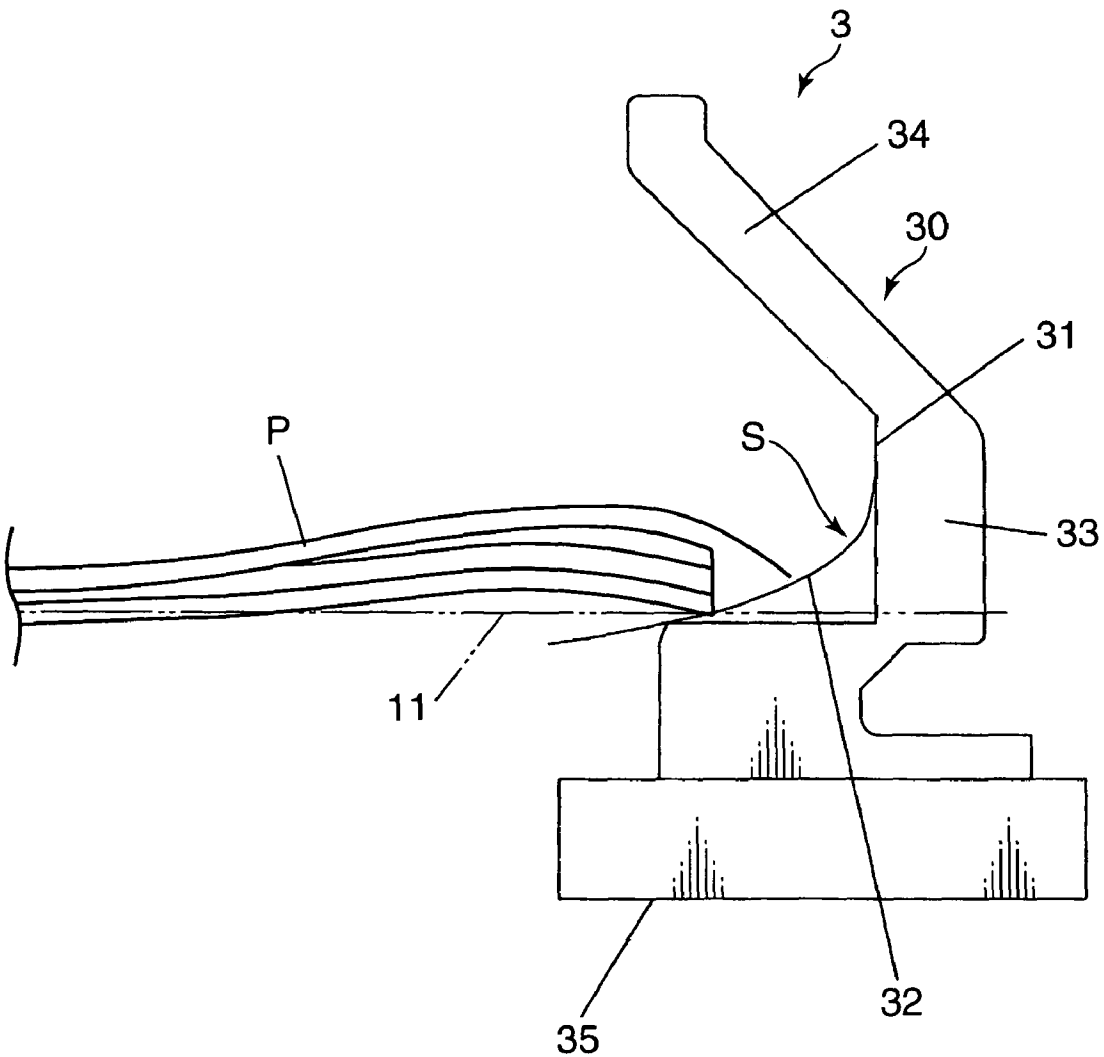
FIG. 5 is a partial enlarged view of a front-end aligning member of FIG. 3.
Figure 6A:
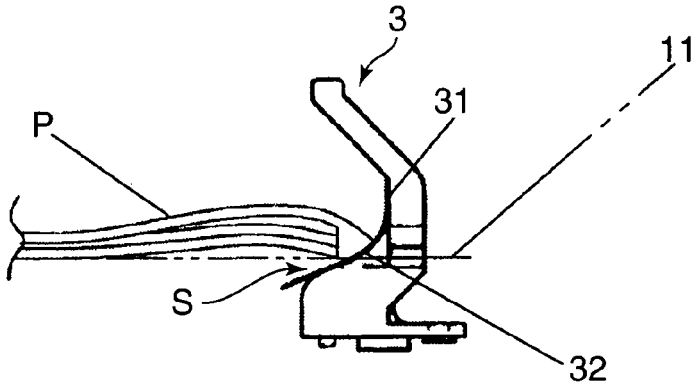
FIGS. 6A to 6C are diagrams showing an aligning operation of the aligning unit according to the embodiment of the invention.
Figure 6B:
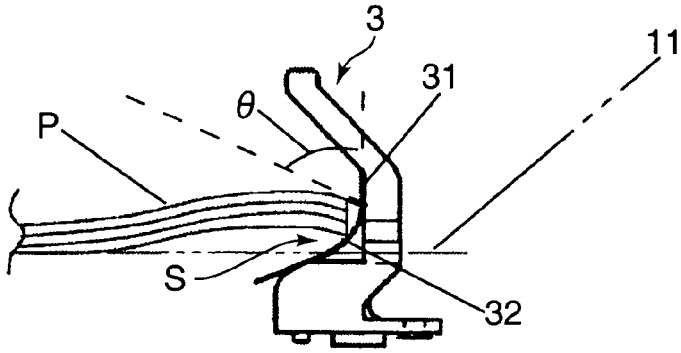
Figure 6C:
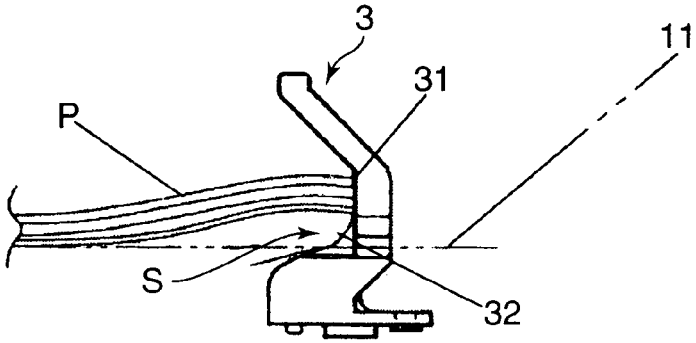
Figure 7:
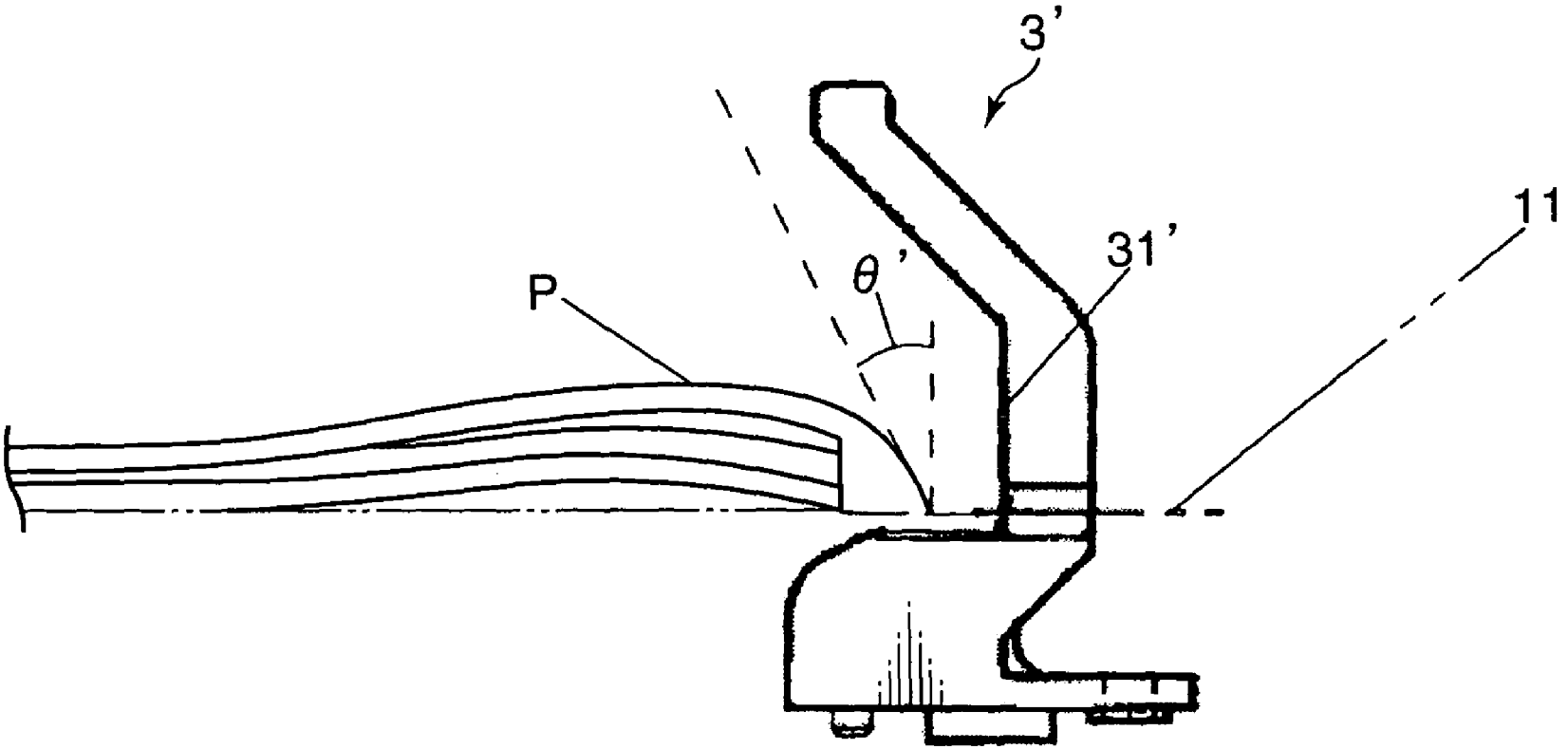
PRIOR ART FIG.7
FIG. 7 is a diagram as a reference showing an aligning operation in a conventional aligning unit.

The aligning unit 103 is described in more detail. FIG. 5 is a partial enlarged diagram of the front-end restricting member 3 of FIG. 3, and FIGS. 6A to 6C are diagrams showing the aligning operation of the aligning unit 103, wherein FIG. 6A shows a state when a transfer material P is discharged, FIG. 6B shows a state when the front-end restricting member 3 is slid, and FIG. 6C is a diagram showing a state when the transfer materials P are in contact with the contact surface 31 of the front-end restricting member 3. It should be noted that FIG. 7 is a diagram as a reference showing an aligning operation in a conventional aligning unit.

The front-end restricting member 3 has the contact surface 31 perpendicular to the sliding direction (X-axis direction) (perpendicular to the surfaces of transfer materials P, i.e. to the placing surface 11). The front-end restricting member 3 repeatedly moves back and forth along the X-axis direction every time a transfer material P is discharged onto the intermediate tray 1, wherein the contact surface 31 of the front-end restricting member 3 pushes the front end of the transfer material P during a movement in the −X direction to bring the rear ends of the transfer materials P into contact with the rear-end restricting member 2. In this way, the positions of the transfer materials P on the intermediate tray 1 with respect to a direction of conveyance (X-axis direction) can be aligned.

Here, the guiding member 32 for forming the inclined surface S extending from the contact surface to the placing surface 11 and inclined downward with respect to the −X direction is attached below the contact surface 31. The guiding member 32 is a film-like member narrow and long in a Y-axis direction as shown in FIG. 4, and has an upper longer side thereof fixed to the contact surface 31 as shown in FIG. 5. On the other hand, a lower longer side of the guiding member 32 hangs down toward the placing surface 11. An intermediate part of the guiding member 32 forms the inclined surface S curved to define a moderate convex contour projecting downward in side view. It should be noted that the guiding member 32 of this embodiment is an elastically deformable member made of a PET resin or the like.

By sliding the front-end restricting member 3 having the guiding member 32 obliquely attached to extend from the contact surface 31 toward the placing surface 11, the transfer materials P on the intermediate tray 1 can be scooped up.

In this embodiment, the front-end restricting member 3 includes a main body member 30 integrally formed with a base end portion 35 located below the placing surface 11 and a standing wall 33 extending upward from the base end portion 35 via a slit 12 (see FIG. 4) formed in the intermediate tray 1 and used to form the contact surface 31. The guiding member 32 is attached to such a main body member 30 to form the inclined surface S.

In this case, the base end portion 35 of the main body portion 30 of the front-end restricting member 3 is located below the placing surface 11, and the standing wall 33 extends upward from the base end portion 35 to form the contact surface 31 above the placing surface 11. The intermediate tray 1 has a dent 13 formed at a position lower than the placing surface 11, and the guiding member 32 is located to extend above and below the placing surface 11 at the position of the dent 13. In other words, the dent 13 is provided below the placing surface 11 of the intermediate tray 1 so that the bottom end of the guiding member 32 can move back and forth below the placing surface 11. It should be noted that displacement preventing guides 14 projecting above the placing surface 11 are provided to prevent easy displacements of the transfer materials P placed on the placing surface 11.

By locating the base end portion 35 below the placing surface 11, a driving portion (not shown) for the front-end restricting member 3 can be disposed below the placing surface 11, so that the front-end restricting member 3 can be driven without interfering with the transfer materials P discharged onto the intermediate tray 1. Further, since the guiding member 32 is located above and below the placing surface 11 by the presence of the dent 13 formed below the placing surface 11, the transfer materials P can be brought into contact with the inclined surface S without getting caught by the bottom end of the guiding member 32 during forward and backward movements of the front-end restricting member 3.

In this embodiment, the transfer material P is discharged onto the intermediate tray 1 from a side above the rear end of the transfer materials P on the intermediate tray 1 (side above the end with respect to the −X direction in FIG. 3). At this time, the transfer material P discharged last onto the intermediate tray 1 is likely to be discharged more forward than the already discharged and stacked transfer materials P as shown in FIG. 6A. Particularly, such a likelihood is notable in the case where the already discharged and stacked transfer materials P are curved downward as shown in FIG. 6A, and there are cases where the front ends of the transfer materials P are in touch with the placing surface 11 of the intermediate tray 1. Here, the front-end restricting member 3 is slid in the X-axis direction (moved in the −X direction).

Then, the uppermost transfer material P (to be aligned) comes into contact with the guiding member 32, and the front end thereof is scooped up along the inclined surface S of the guiding member 32 as the rear-end restricting member 2 approaches. At this time, the already discharged and stacked transfer materials P have the front ends thereof also scooped up along the inclined surface S of the guiding member 32. Here, since the guiding member 32 is made of an elastic material, the action of scooping the stacked transfer materials P up by the guiding member 32 is improved.

As a comparative example, a case where the inclined surface S of the guiding member 32 is not present is shown in FIG. 7. In this case, if the front end of a transfer material P comes into contact with the placing surface 11 of the intermediate tray 1 when the transfer material P is discharged onto the intermediate tray 1, the transfer material P comes into contact with a contact surface 31' of a front-end restricting member 3' without being scooped up. This means that an angle θ' between a front end portion of the transfer material P and the contact surface 31' of the front-end restricting member 3' is small (close to 0°). Further, since transfer materials P already discharged and stacked are not scooped up, either, the uppermost transfer material P comes to be sandwiched between (a stack of) the already discharged and stacked transfer materials P and the contact surface 31' of the front-end restricting member 3'. Therefore, the transfer materials P cannot be aligned with respect to the X-axis direction and, in addition, the uppermost transfer material P might be buckled at the front end corner of the stack of the already discharged and stacked transfer materials P.

Contrary to this, in this embodiment, an angle θ between front end portions of the transfer materials P and the contact surface 31 of the front-end restricting member 3 is larger than the above angle θ' and the front end portions of the transfer materials P come into contact with the contact surface 31 at an angle approximate to a right angle as shown in FIG. 6B by the transfer materials P being scooped up. By the contact of the front end portions of the transfer materials P with the contact surface 31 of the front-end restricting member 3 at the angle approximate to the right angle, the sliding action of the front-end restricting member 3 in the X-axis direction can be effectively applied to the transfer materials P.

If the front-end restricting member 3 is moved in a direction away from the transfer materials P (+X direction) thereafter, the aligned transfer materials P come to be placed on the placing surface 11 along the inclined surface S of the guiding member 32. Here, since being an elastically deformable member, the guiding member 32 is elastically deformed due to its elasticity if the transfer materials P come into contact with the guiding member 32 again after being scooped up and aligned by the contact surface 31, thereby preventing the alignment of the transfer materials P from being disordered.

Further, in this embodiment, the inclined surface S of the guiding member 32 is curved to define a moderate convex contour projecting downward in side view. In other words, the inclined surface S of the guiding member 32 has a concave (arcuate) contour opening upward in side view (section normal both to the contact surface 31 of the front-end restricting member 3 and to the placing surface 11 of the intermediate tray 1). Accordingly, the aforementioned angle θ between the front end portions of the transfer materials P and the inclined surface S of the guiding member 32 when the downward curled transfer materials P come into contact with the guiding member 32 is likely to be constantly approximate to the right angle, wherefore the guiding member 32 can align the front end portions of the transfer materials P while effectively pushing them back. Further, by such a shape of the guiding member 32, the transfer materials P can be smoothly placed on the placing surface 11 to prevent the alignment thereof from being disordered when the transfer materials P come into contact with the guiding member 32 again after being scooped up and aligned.

As described above, even if the transfer materials P on the tray 1 are curled downward, the positions of the transfer materials P can be restricted by the contact surface 31 while these curled parts of the transfer materials P are scooped up, wherefore the transfer materials P can be highly precisely aligned without being buckled.

It should be noted that the front-end restricting member 3 of this embodiment includes an inclined wall 34 (upper inclined surface) formed above the contact surface 31 to be inclined upward from the standing wall 33 having the contact surface 31 toward the rear-end restricting member 2 (toward the left side of FIG. 2). By forming this inclined wall 34, the front-end restricting member 3 can also effectively restrict transfer materials P curled upward.

In this embodiment, the width restricting members 4, 5 move back and forth to repeatedly move toward and away from each other every time the transfer material P is discharged onto the intermediate tray 1, wherein they press the left and right ends of the transfer materials P upon moving toward each other. In this way, the transfer materials P on the intermediate tray 1 have the positions thereof adjusted with respect to a direction (Y-axis direction) normal to a conveying direction of the transfer materials P.

It should be noted that, upon performing the aforementioned aligning operation, the front-end restricting member 3 moves to a position, where a distance to the rear-end restricting member 2 is slightly shorter than the length of the transfer materials P along the conveying direction (length along a direction normal to a width direction), to securely align the positions of the transfer materials P with respect to the conveying direction. Similarly, upon performing the aforementioned aligning operation, the above width restricting members 4, 5 move to positions, where a distance therebetween is slightly shorter than a dimension of the transfer materials P along the width direction, to securely align the positions of the transfer materials P with respect to the width direction.

The above width restricting members 4, 5 also function as a conveying mechanism for conveying the transfer materials P on the intermediate tray 1 a specified distance along a direction (Y-axis direction) normal to the sliding direction (X-axis direction) of the front-end restricting member 3 and parallel to the sheet surfaces of the transfer materials P while defining the width of the restricted transfer materials P. After the aforementioned aligning operation, the width restricting members 4, 5 move the transfer materials P on the intermediate tray 1 forward (toward the front side) to a position P' corresponding to a stapler 104 as a post-processing unit arranged at the front side of the image forming apparatus 10, and again move the transfer materials P backward after stapling to return them to the initial position.

It should be noted that at least one of the rear-end restricting member 2 and the width restricting members 4, 5 may include a guiding member 32 similar to the front-end restricting member 3 of this embodiment. By providing either one of the width restricting members 4, 5 with the guiding member 32, the transfer materials P can be highly precisely aligned without being buckled even during the aligning operation in the Y-axis direction.

The inclined surface S of the guiding member 32 in this embodiment is formed to have such a width that is shorter than that of the contact surface 31 and that the transfer materials P come into contact with the inclined surface S within a range of conveyance by the width restricting members 4, 5 as a conveying mechanism as shown in FIG. 2.

In this case, the width of the guiding member 32 is shorter than that of the contact surface 31. Accordingly, the guiding member 32 can be arranged without standing as a hindrance to other members while effectively taking advantage of the elasticity of the guiding member 32 itself. Further, even if the elasticity of the guiding member 32 itself is somewhat low (hard), it can sufficiently undergo an elastic deformation since being short in the width direction.

The transfer materials P on the intermediate tray 1 are moved a specified distance in the direction (Y-axis direction) normal to the sliding direction (X-axis direction) of the front-end restricting member 3 (i.e. moved a specified distance along a surface in parallel with the contact surface 31) by the width restricting members 4, 5 to advance toward the post-processing unit (stapler) 104 for the post-processing such as stapling. After the post-processing such as stapling, the transfer materials P are moved again to the initial alignment position and the rear-end restricting member 2 is switched to its retracted state to convey the transfer materials P in the −X direction and discharge them onto the discharge tray 105.

Here, the guiding member 32 has such a width that the inclined surface S can be held in contact with the transfer materials P at the position P' of the transfer materials P after the above movement (the contact of the transfer materials P with the inclined surface S is kept even after the movement). Thus, even after the movement by the width restricting members 4, 5 as the conveying mechanism, at least a widthwise end portion of the guide member 32 toward a moving side is located between the front ends and the rear ends of the transfer materials P with respect to the moving direction (Y-axis direction). Accordingly, it can be prevented that the ends of the transfer materials P get caught by the guiding member 32 when the transfer materials P are moved again to the initial alignment position after the post-processing.

The embodiment of the present invention is described above, but the present invention is not limited to the above embodiment and various improvements, changes and modifications can be made without departing from the spirit and scope of the present invention.

For example, although the front-end restricting member 3 is formed by connecting the guiding member 32 to the main body member 30 in the foregoing embodiment, the present invention is not limited thereto. The front-end restricting member 3 may be formed of resin or the like such that the main body member and the guiding member (inclined surface S) are integral to each other. In such a case, the guiding member can be made elastically deformable by being formed thinner than other parts.

The specific embodiment described above mainly contains inventions having the following constructions.

An aligning unit according to one aspect of the present invention comprises a tray having a placing surface on which sheet-like transfer materials discharged with printing applied thereto are held stacked, a first restricting member movable back and forth along an advancing direction of the transfer material being discharged onto the tray while facing the front end of the transfer material with respect to the advancing direction, and a second restricting member for defining the rear end position of the transfer material with respect to the advancing direction. The transfer materials stacked on the tray are aligned by moving the first restricting member back and forth along the advancing direction. The first restricting member has a contact surface extending substantially vertically above the placing surface of the tray and an inclined surface extending from the contact surface toward the placing surface and inclined downward along a direction opposite to the advancing direction.

According to the aligning unit having the above construction, the second restricting member restricts the rear ends of the transfer materials on the tray with the transfer materials after printing held stacked on the placing surface of the tray, whereas the first restricting member disposed to face the second restricting member is moved back and forth along the advancing direction of the transfer material being discharged onto the tray and the contact surface extending substantially vertically above the placing surface of the tray restricts the front ends of the transfer materials. In this way, the transfer materials are aligned at a specified alignment position.

Here, the first restricting member has the contact surface normal to a sliding direction and the inclined surface extending from the contact surface toward the placing surface and inclined downward along the direction opposite to the advancing direction. By moving the first restricting member having such an inclined surface back and forth, the action of scooping up the transfer materials on the tray is fulfilled. Accordingly, even if the transfer materials on the tray are curled downward, the positions of the transfer materials can be restricted by the contact surface while the curled parts are scooped up. Therefore, the transfer materials can be highly precisely aligned without being buckled.

In the above construction, the inclined surface is preferably curved to define a convex contour projecting downward in side view. With this construction, an angle between the transfer materials and the inclined surface is likely to approximate to a right angle when the transfer materials curled downward come into contact with the inclined surface, and the end of the transfer material can be aligned while being effectively pushed back by the inclined surface.

In the above construction, the first restricting member preferably includes a main body member integrally formed with a base end portion located below the placing surface and a standing wall extending upward from the base end portion through a slit formed in the tray and used to form the contact surface, and a guiding member attachable to the main body member and having the inclined surface.

With this construction, a driving portion for the first restricting member can be disposed below the placing surface by locating the base end portion of the main body member of the first restricting member below the placing surface, wherefore the first restricting member can be driven without interfering with the transfer material discharged onto the tray.

In this case, it is more preferable that the tray has a dent formed below the placing surface, and that the guiding member is so located as to extend above and below the placing surface at the position of the dent. With this construction, the transfer materials can be brought into contact with the inclined surface without getting caught by the bottom end of the guiding member when the first restricting member is moved back and forth.

Preferably, the guiding member is formed of an elastically deformable member. By forming the guiding member of the elastically deformable member, the action of the guiding member to scoop up the transfer materials can be improved. Further, the elastic member is elastically deformed if the transfer material comes into contact with the guiding member again after being scooped up and aligned by the contact surface, thereby preventing the aligned transfer materials from being disordered again.

In the above construction, the guiding member preferably is made of a film-like member and has one end thereof attached to the contact surface.

Further, the first restricting member preferably has an upper contact surface located above the contact surface, extending from the contact surface toward the second restricting member and inclined upward along the direction opposite to the advancing direction.

In the above construction, it is preferable that the aligning unit further comprises a conveying mechanism for conveying the transfer materials stacked on the placing surface of the tray in a direction normal to the advancing direction and in parallel with the sheet surfaces of the transfer materials; and that the inclined surface has such a width as to be held in contact with the transfer materials within a range of conveyance by the conveying mechanism.

In this case, the transfer materials on the tray are conveyed by the conveying mechanism in the direction normal to the advancing direction of the transfer materials and in parallel with the sheet surfaces of the transfer materials for post-processing such as stapling. The inclined surface of the guiding member has such a width as to be held in contact with the transfer materials within the range of conveyance by the conveying mechanism. Thus, even after the conveyance by the conveying mechanism, at least a widthwise end of the guiding member toward a conveying side is located between the front ends and the rear ends of the transfer materials with respect to a conveying direction. Therefore, it can be prevented that the ends of the transfer materials get caught by the guiding member when the transfer materials are conveyed to the initial alignment position again after the post-processing.

As described above, according to the aligning unit and the image forming apparatus of the present invention, the action of scooping up the transfer materials on the tray is fulfilled by moving the first restricting member having the guiding member attached thereto between the contact surface and the inclined surface back and forth. Accordingly, even if the transfer materials on the tray are curled downward, the positions of the transfer materials can be restricted by the contact surface while the curled parts are scooped up, wherefore the transfer materials can be highly precisely aligned without being buckled.

This application is based on patent application No. 2006-145303 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An aligning unit, comprising:

a tray having a placing surface on which sheet-like transfer materials discharged with printing applied thereto are held stacked;

a dent provided in the tray and formed below the placing surface;

a first restricting member movable back and forth along an advancing direction of the transfer material being discharged onto the tray while facing the front end of the transfer material with respect to the advancing direction; and a second restricting member for defining the rear end position of the transfer material with respect to the advancing direction, wherein:

the transfer materials stacked on the tray are aligned by the first restricting member being moved back and forth along the advancing direction, the first restricting member includes a base end portion located below the placing surface and movable back and forth along the advancing direction in response to a driving force, a standing wall extending upward from the base end portion and having a contact surface extending substantially vertically above the placing surface of the tray, and an inclined surface extending from the contact surface toward the placing surface and inclined downward along a direction opposite to the advancing direction, and the dent extends along the advancing direction, the base end portion is moved back and forth in a state that the base end portion is accommodated in the dent, and the bottom end of the inclined surface moved back and forth below the placing surface along the extending direction of the dent.

2. An aligning unit according to claim 1, wherein the inclined surface is curved to define a convex contour projecting downward in side view.

3. An aligning unit according to claim 1, wherein the first restricting member includes:

a main body member integrally formed with a base end portion located below the placing surface and a standing wall extending upward from the base end portion through a slit formed in the tray and used to form the contact surface, and a guiding member attachable to the main body member and having the inclined surface.

4. An aligning unit according to claim 3, wherein the guiding member is formed of an elastic deformable member.

5. An aligning unit according to claim 4, wherein the guiding member is made of a film-like member and has one end thereof attached to the contact surface.

6. An aligning unit according to claim 3, wherein the first restricting member has an upper contact surface located above the contact surface, extending from the contact surface toward the second restricting member and inclined upward along the direction opposite to the advancing direction.

7. An aligning unit according to claim 1, further comprising a conveying mechanism for conveying the transfer materials stacked on the placing surface of the tray in a direction normal to the advancing direction and in parallel with the sheet surfaces of the transfer materials, wherein the inclined surface has such a width as to be held in contact with the transfer materials within a range of conveyance by the conveying mechanism.

8. An image forming apparatus, comprising:

an apparatus main body for applying an image forming process to a transfer material, and an aligning unit for aligning transfer materials after the image formation, wherein the aligning unit includes:

a tray having a placing surface on which sheet-like transfer materials discharged with printing applied thereto are held stacked;

a dent provided in the tray and formed below the placing surface;

a first restricting member movable back and forth along an advancing direction of the transfer material being discharged onto the tray while facing the front end of the transfer material with respect to the advancing direction;

a second restricting member for defining the rear end position of the transfer material with respect to the advancing direction, the transfer materials stacked on the tray being aligned by the first restricting member being moved back and forth along the advancing direction, and the first restricting member including a base end portion located below the placing surface and movable back and forth along the advancing direction in response to a driving force, a standing wall extending upward from the base end portion and having a contact surface extending substantially vertically above the placing surface of the tray, and an inclined surface extending from the contact surface toward the placing surface and inclined downward along a direction opposite to the advancing direction, and the dent extends along the advancing direction, the base end portion is moved back and forth in a state that the base end portion is accommodated in the dent, and the bottom end of the inclined surface moved back and forth below the placing surface along the extending direction of the dent.

9. An image forming apparatus according to claim 8, further comprising a post-processing unit for applying specified post-processing to the transfer material after the image formation, wherein the transfer material after the image formation is conveyed toward the post-processing unit after being aligned by the aligning unit.

10. An image forming apparatus according to claim 8, wherein the inclined surface is curved to define a convex contour projecting downward in side view.

11. An image forming apparatus according to claim 8, wherein the first restricting member includes:

a main body member integrally formed with a base end portion located below the placing surface and a standing wall extending upward from the base end portion through a slit formed in the tray and used to form the contact surface, and a guiding member attachable to the main body member and having the inclined surface.

12. An image forming apparatus according to claim 11, wherein the guiding member is formed of an elastic deformable member.

13. An image forming apparatus according to claim 11, wherein the guiding member is made of a film-like member and has one end thereof attached to the contact surface.

14. An image forming apparatus according to claim 11, wherein the first restricting member has an upper contact surface located above the contact surface, extending from the contact surface toward the second restricting member and inclined upward along the direction opposite to the advancing direction.

15. An image forming apparatus according to claim 8, further comprising a conveying mechanism for conveying the transfer materials stacked on the placing surface of the tray in a direction normal to the advancing direction and in parallel with the sheet surfaces of the transfer materials, wherein the inclined surface has such a width as to be held in contact with the transfer materials within a range of conveyance by the conveying mechanism.

* * * * *